US009067113B2

(12) United States Patent
Kammer

(10) Patent No.: US 9,067,113 B2
(45) Date of Patent: Jun. 30, 2015

(54) BASEBALL'S 3-IN-1 ZONE TRAINER

(71) Applicant: Kenneth Lee Kammer, Paris, TX (US)

(72) Inventor: Kenneth Lee Kammer, Paris, TX (US)

( * ) Notice: Subject to any disclaimer, the term of this patent is extended or adjusted under 35 U.S.C. 154(b) by 77 days.

(21) Appl. No.: 14/039,658

(22) Filed: Sep. 27, 2013

(65) Prior Publication Data

US 2015/0094173 A1 Apr. 2, 2015

(51) Int. Cl.
*A63B 69/00* (2006.01)

(52) U.S. Cl.
CPC ..... *A63B 69/0002* (2013.01); *A63B 2069/0006* (2013.01); *A63B 2225/093* (2013.01); *A63B 2069/0008* (2013.01)

(58) Field of Classification Search
CPC ..... A63B 69/00; A63B 69/0002; A63B 69/0057; A63B 69/0091; A63B 69/0079
USPC ..... 473/422, 417, 451, 453, 428–430; D21/780
See application file for complete search history.

(56) References Cited

U.S. PATENT DOCUMENTS

| | | | | | |
|---|---|---|---|---|---|
| 3,475,026 | A * | 10/1969 | Cooper | 473/430 |
| 3,937,464 | A * | 2/1976 | Zalewski | 473/428 |
| 3,940,131 | A * | 2/1976 | St. Claire, Jr. | 473/417 |
| 3,948,517 | A * | 4/1976 | Feiler | 473/429 |
| D246,123 | S * | 10/1977 | Scoggins | D21/780 |
| 4,451,036 | A * | 5/1984 | Sinclair et al. | 473/453 |
| 4,516,771 | A * | 5/1985 | Nau | 473/453 |
| 5,087,039 | A * | 2/1992 | Laseke | 473/417 |
| 6,461,255 | B1 * | 10/2002 | Smith | 473/417 |
| 7,300,365 | B2 * | 11/2007 | Taylor | 473/451 |
| 2006/0089212 | A1 * | 4/2006 | Marchel | 473/422 |
| 2006/0148597 | A1 * | 7/2006 | Pope et al. | 473/453 |
| 2006/0240917 | A1 * | 10/2006 | Campbell et al. | 473/453 |
| 2007/0129182 | A1 * | 6/2007 | Taylor | 473/422 |

* cited by examiner

*Primary Examiner* — Mitra Aryanpour

(57) ABSTRACT

BASEBALL'S 3-IN-1 ZONE TRAINER is a device for training and conditioning three player-position, at the same time or in pairs or individually, to maximize their individual skill level in the art and science of the pitching, hind-catching and hitting of a baseball; all of which is dependent upon the strike zone for their successful mastery of this aspect of the game. BASEBALL'S 3-IN-1 ZONE TRAINER is comprised of four primary connecting sections for ease of assembling and disassembling: Section 1—the stable metal horizontal Base Plate, color-coded red, provides for the connecting of, Section 2—the stable metal vertical Telescopic Height Base and Adjustable Posts, which allows for a true and individualized strike zone for all three player-position to practice within, is also color-coded red and provides two locations for the connecting of, Section 3—the Upper and Lower Strike Zone Arms comprised of a combination of flexible materials (i.e.; rubber, plastics and FIBERGLAS (flexible fibrous glass) for defining the horizontal and vertical yellow and green color-coded strike zone; and finally, Section 4—the Diamond-shaped Double-edge Deflective-style Closed-cell Rubber-molded Coverings. These coverings are presecured to Sections 2 and 3. The color-codes of this 3-In-1 baseball player-positions training apparatus identifies the green zone as the strike zone, the yellow zone as located just outside the strike zone, and the red zone is indicative of being far outside of the strike zone. The weighted stability of the 1st and 2nd sections, the red zone provides the needed support for the sturdy yet flexible construction of the 3rd and 4th sections, that being the yellow and green zones.

9 Claims, 2 Drawing Sheets

BASEBALL'S 3-IN-1 ZONE TRAINER

CROSS-REFERENCE TO RELATED APPLICATIONS

I realize, due to the late filing of this nonprovisional utility patent application, my provisional utility patent application (Customer #000108173, Reference #30755895, and application Ser. No. 61/683,041 filed Aug. 14, 2012) became ineffective in reserving a beginning date as purposed.

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

The present invention relates to sports training apparatus and, more specifically, to strike zone training devices for pitchers, hind-catchers and batters in the game of baseball.

In the sport of baseball a pitcher must propel the baseball at a target selected by the hind-catcher toward the batter's strike zone in-order for the game to begin and most often end. Using various ball-throw types the pitcher attempts to strike the batter out or at least minimize their hitting ability. The hind-catcher places the catcher's mitt within or around the strike zone for the pitcher to throw the baseball to. These targets should best identify the batter's weaknesses. Using a baseball bat, the batter must execute a coordinated swing for a successful hit of the baseball into or out of the field. A successful hit by the batter is determined by a variety of factors at a particular point in the game itself. Although general body strength and endurance are necessary, certain specific muscles or muscle groups are primarily employed during the pitching, hind-catching and batting of the baseball; yet, all three player-positions are dependent upon the strike zone for their individual and team's success.

In most sports conditioning, athletes engage in various exercises to strengthen and train the primary muscle groups needed for mastering a particular sport, and more specifically a player-position within that sport. In some instances, additional training apparatus are used for more concentrated training. In baseball, for these specific player-positions, athletes practice pitching, hind-catching and hitting the baseball to increase their manipulative skills while at the same time strengthening the muscles and visual focus needed for each of these functions.

It is a typical feature of sports training apparatus within the game of baseball to concentrate the training to one particular player-position at a time, whether pitching or batting, while the catcher player-position is typically left without a practice device altogether (i.e., U.S. Pat. Nos. 7,771,294 and 6,443,859 and 4,886,267). The present invention is designed specifically for training all three afore mentioned player-positions, whether practicing individually or altogether.

It is the principle object of the present invention to provide a strikingly new and improved apparatus for training baseball's pitchers and hind-catchers and batters with one device that optimizes each player-position's muscular conditioning and visual focus.

Another object is to provide a baseball training apparatus that allows multiple player-positions to improve their skill level at each of those positions that centers on baseball's all important strike zone. This invention allows for the individualized defining of the specific parameter needed for each player-position to perform their assigned player duties.

A still further object is to provide a baseball training device adapted for occasionally repeated, forceful hits by a baseball bat or ball which is of extremely durable materials and structurally sound design.

Other objects will in part be obvious and in part appear hereinafter.

BRIEF SUMMARY OF THE INVENTION

In furtherance of the foregoing objects, the invention contemplates a baseball training apparatus having a horizontal metal base support structure that includes two angle iron sticks welded to a metal plate that is welded to a small metal holding coupling, as well as, a clamping collar that is welded to the holding coupling. This constitutes Baseball's 3-In-1 Zone Trainer Base Plate, the first section, and provides the stabilizing foundational support for this invention.

The second section, known as Baseball's 3-1n-1 Zone Trainer Telescopic Height Base and Adjustable Posts, is comprised of the two vertical metal support posts. The first vertical support hollow metal tubing member, also referred to the base post, is comprised of two equal metal tubing parts joined by a metal tee and two clamping collar. These clamping collars are located at the top end of this base post and at the horizontal reducing leg of the metal tee. The second vertical support hollow metal tubing member fits inside the first vertical support hollow metal tubing creating an individualized telescopic height adjustment capability. A metal reducing elbow is welded to the top of this support tubing and a metal collar clamp is welded to the reducing elbow leg. Together, these combined vertical parts provide the needed connective support for the final section that defines the invention's strike zone for the sport of baseball and the training of the afore mentioned player-positions.

The third section is comprised of two like parts referred to as Baseball's 3-In-1 Zone Trainer Strike Zone Upper and Lower Arms. Each arm defines the upper and lower boundaries of the strike zone and is constructed of a threaded FIBERGLAS (flexible fibrous glass) rod have a small rubber hose at the post connecting end, a PVC (polyvinyl chloride) tee and elbow with each having a connecting PVC (polyvinyl chloride) nipple extension to be fixed to define the inside and outside limits to the strike zone.

All sections, with the exception of Baseball's 3-In-1 Base Plate section which is painted red, are enclosed in the fourth section, Baseball's 3-In-1 Zone Trainer Double-edged Diamond-shaped Deflective-style Closed-cell Rubber-molded Coverings. Each section is color-coded red, yellow or green for the purpose of clearly defining where the strike zone is and is not for all three player-positions.

In operation, the apparatus is adjustable to the individualized upper strike zone limit while the lower strike zone limit is fixed for most all nine year olds through adult age baseball players.

This invention is designed to restrict the targeting of the baseball by the hind-catcher, the throwing to the baseball by the pitcher and the hitting of the baseball by the batter. Due to the composition of the construction materials, this invention provides the structural stability to maintain the desired strike zone, while at the same time provide the needed flexibility if and when the training apparatus is occasionally struck by a baseball bat or ball. Thus, the elements are returned to their original position by the rebounding action inherent in the composite of the construction materials.

DETAILED DESCRIPTION OF THE INVENTION

Figure 1:
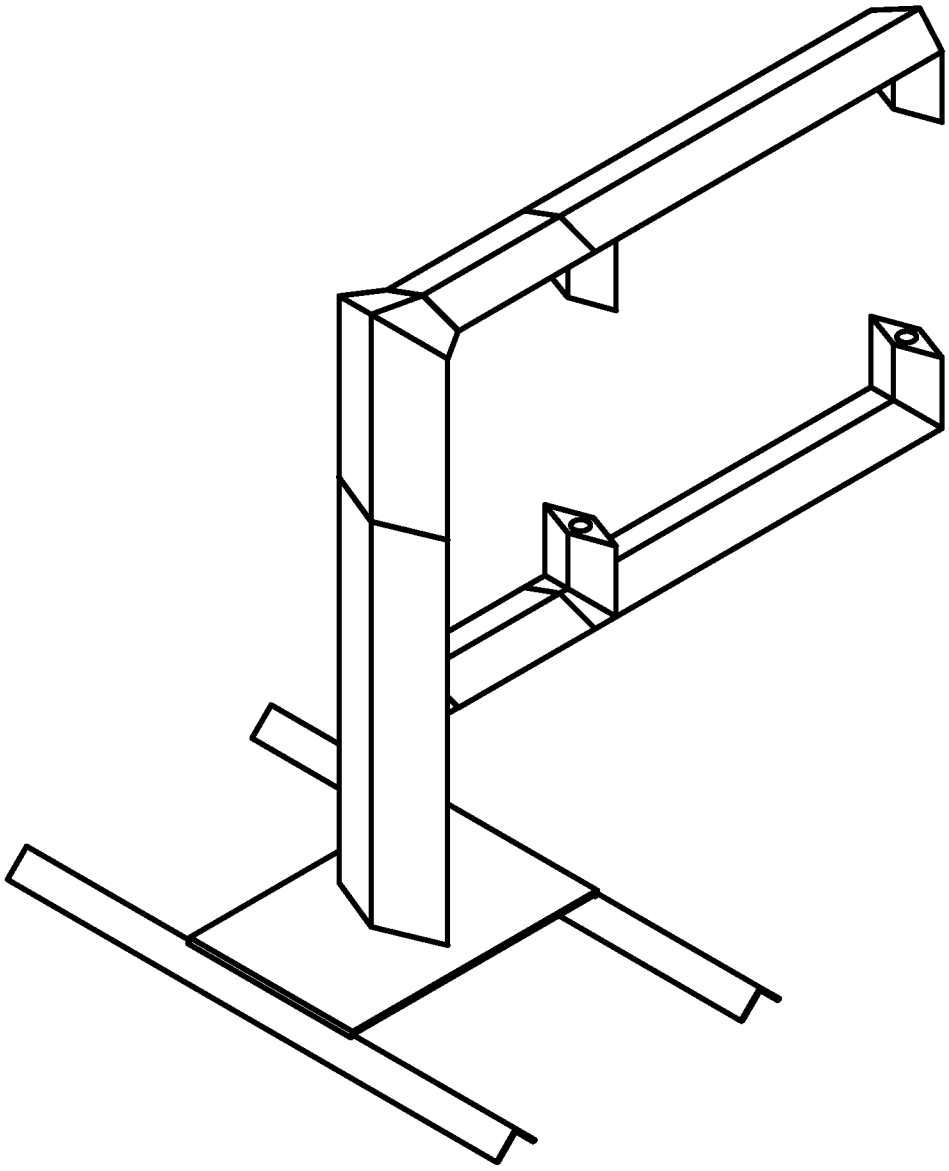
FIG. 1 is a full view of the invention, BASEBALL'S 3-IN-1 ZONE TRAINER, enclosed with its diamond-shaped double-edged deflective-style closed-cell rubber-molded coverings.
Figure 2:
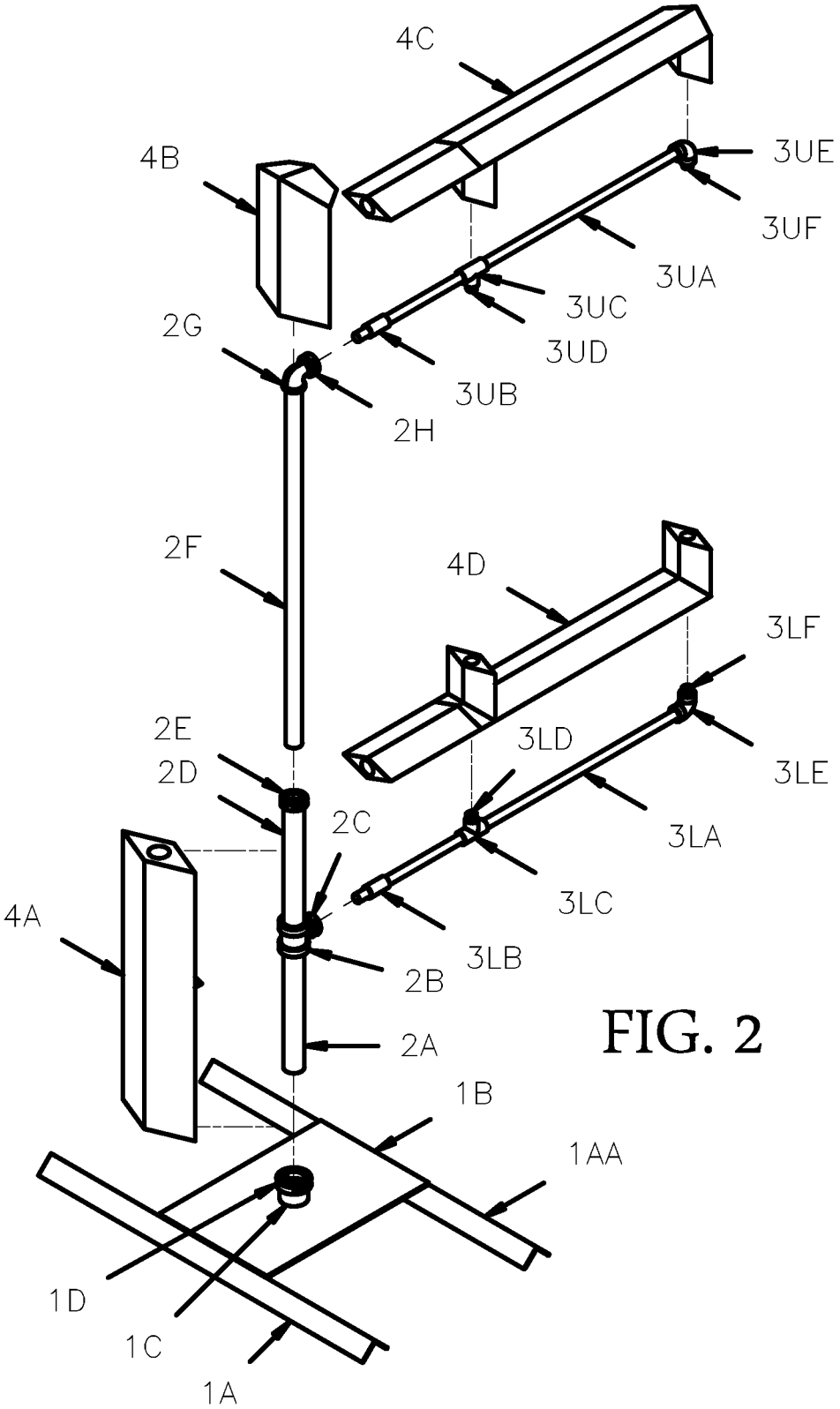
FIG. 2 is an exploded view of the invention, BASEBALL'S 3-IN-1 ZONE TRAINER, showing the individual parts of the diamond-shaped double-edged deflective-style closed-cell rubber-molded coverings separate from the inventions core structure itself with its individual parts.

Referring now to the drawings, the training apparatus of the invention includes four basic sections: Section 1—Baseball's 3-In-1 Zone Trainer Base Plate—a metal base support plate intended to rest on a substantially horizontal surface while the apparatus is in use in its principal anticipated application; Section 2—Baseball's 3-In-1 Zone Trainer Telescopic Height Base and Adjustable Posts—affixed to the base support is a metal telescopic zone height base post with a 2-piece clamping collar for the inserted metal telescopic height adjustable post for the purpose of individualizing the position of the upper and lower boundaries of the strike zone; Section 3—Baseball's 3-In-1 Zone Trainer Strike Zone Upper and Lower Arms—two FIBERGLAS (flexible fibrous glass) rods called the arms that thread into and are secured by means of two 2-piece clamping collars, one joined at the horizontal tee joint leg of the metal telescopic zone height base post for defining the lower boundary, and the other joined at the horizontal reducing elbow joint affixed to the top of the inserted metal telescopic height adjustable post for defining the upper boundary. These two arms each have two small vertical positioned extensions to define the inner and outer boundaries of the strike zone itself; and Section 4—Baseball's 3-In-1 Zone Trainer Diamond-shaped Double-edged Deflective-styled Closed-cell Rubber-molded Coverings are secured to Sections 2 and 3 as shown in both FIGS. 1 and 2. The first drawing (FIG. 1) shows the view of a completely assembled invention; and, the second drawing (FIG. 2) shows an exploded view with each sections individual parts of the same. All four sections are preassembled, and sections 3, 4 and 5 are pre-enclosed with its specialized rubber-molded covering.

Section 1—Baseball's 3-In-1 Zone Trainer Base Plate (FIG. 2) as denoted by reference numeral 1 and corresponding sub-lettering, is comprised of two angle irons 2"×2"×36 L"×⅛" TH (1A and 1AA). Welded to them and centered is a metal plate 12"×18" W×3/16" TH (1B). And, welded to the metal plate is a 1¼" threaded metal coupling (1C). At the top of this coupling, is welded a 1 11/16" 2-piece clamping collar (1D). This base plate rests horizontally on level ground.

Section 2—Baseball's 3-1n-1 Zone Trainer Telescopic Height Base and Adjustable Posts (FIG. 2) as denoted by reference numeral 2 with corresponding parts sub-lettering, are made of two separate vertical posts, the base post and the telescopic height adjustable post, along with their connecting joints and locking devices. The base post is made of a 1¼"×12" threaded metal pipe (2A) welded to a threaded 1¼"×½"×1¼" reducing metal TEE (2B). At the ½" reducing tee is welded a ¾" 2-piece clamping metal collar (2C). Another 1¼"×12" metal pipe (2D) at its threaded end is welded to the top of the tee. At the non-threaded end of this same pipe has welded to it a 1 5/16" 2-piece clamping metal collar (2E). The telescopic height adjustable post is comprised of three welded parts: a 1"×36" black metal pipe (2F) with a 1"×½" reducing 90° metal elbow (2G) and a ¾" 2-piece clamping metal collar (2H). During assembling, the bottom pipe is threaded to the base plate and secured in position by the base plate's 2-piece clamping metal collar. The upper adjustable post slides into the lower base post and secured to its desired height by the 2-piece clamping metal collar.

Section 3—Baseball's 3-In-1 Zone Trainer Upper and Lower Strike Zone Arms (FIG. 2) are identical in design and identified by the numeral 3 and related sub-lettering. Each arm is comprised of a ¾" FIBERGLAS (flexible fibrous glass) rod (3UA & 3LA) that is threaded at both ends. Each rod has a ¾"×2" rubber hose sleeve (3UB & 3LB) at the connecting end to the Telescopic Zone Height Base and Adjustable Posts, a schedule 40½" skt female×½" npt female×½" skt female PVC (polyvinyl chloride) tee (3UC & 3LC) with a threaded schedule 40½" npt PVC (polyvinyl chloride) close nipple (3UD & 3LD) at the 24" mark to identify the outside strike zone and a threaded schedule 40½" npt 90° PVC (polyvinyl chloride) elbow (3UE & 3LE) with a threaded schedule 40½" npt PVC (polyvinyl chloride) close nipple (3UF & 3LF) located at the far end of the FIBERGLAS (flexible fibrous glass) rod to identify the inside strike zone. Therefore, Baseball's 3-In-1 Zone Trainer Upper and Lower Strike Zone Arms define all four sides of this sport's baseball strike zone.

Section 4—Baseball's 3-In-1 Zone Trainer Diamond-shaped Double-edged Deflective-style Closed-cell Rubber-molded Coverings (FIG. 2) is the final section and identified by the numeral 4 and its sub-lettering. This section is comprised of one lower base post red-coded covering (4A), one upper adjustable post red-coded covering (4B), one upper strike zone arm covering (4C) and one lower strike zone arm covering (4D). Although each strike zone arm covering are made in one piece, both strike zone arm coverings have a yellow-coded area and a green-coded area. The yellow-coded area indicates just outside the strike zone and is the area that connects at the Section 2 vertical connection points (2C & 2H), while the green-coded area is the strike zone itself. This covering serves two primary functions. First, they have a color coded design serving to give clarity to where the true strike zone is located for each individual player-position afore mentioned. The green colored area clearly identifies the strike zone itself, while the yellow colored area shows each player-position where just outside the strike zone is and the red colored area indicates that the play itself is way outside the strike zone. Second, the diamond-shaped double-edged deflective-style closed-cell rubber coverings are intended to help reduce the impact of and deflect the baseball or bat when occasionally struck.

DRAWINGS

See attached PDF "BASEBALL'S 3-IN-1 ZONE TRAINER DRAWINGS"

OATHE OR DECLARATION

See attached PDF Signed FORM AIA/01

SEQUENCE LISTINGS

"Not Applicable"

SOME PATENTS RESEARCHED

| Cited Patent | Filing date | Publication date | Applicant | Title |
|---|---|---|---|---|
| U.S. Pat. No. 7,771,294 | Oct. 17, 2006 | Aug. 10, 2010 | Goucher; Steve<br>Nye; William S | Throwing technique trainer |
| U.S. Pat. No. 5,553,847 | May 19, 1995 | Sep. 10, 1996 | Surrency; Tim | Versatile pitcher training device |
| U.S. Pat. No. 6,517,452 | Jul. 10, 2001 | Feb. 11, 2003 | Endres; Wilhelm | Baseball training apparatus |
| U.S. Pat. No. 6,443,859 | Dec. 22, 2000 | Sep. 3, 2002 | Markin; Craig | Baseball training apparatus |
| U.S. Pat. No. 5,303,914 | Jul. 12, 1993 | Apr. 19, 1994 | Cooksey; Dennis W<br>Cooksey; James N | Triple-adjustable height batting practice device |
| U.S. Pat. No. 5,435,545 | Sep. 20, 1993 | Jul. 25, 1995 | Marotta; Sam A | Strike zone trainer for hitting a baseball |
| U.S. Pat. No. 8,512,172 | Feb. 9, 2011 | Aug. 20, 2013 | Glynn; Eugene P | Baseball training apparatus |
| U.S. Pat. No. 4,886,267 | Jul. 29, 1988 | Dec. 12, 1989 | Licciardi; Terrance P<br>Licciardi; James P | Baseball practice apparatus |
| U.S. Pat. No. 6,729,978 | Sep. 26, 2002 | May 4, 2004 | Moss; Robert Allen<br>Smith; Hawthon<br>Campe; Gediminas | Ball hitting practice apparatus |
| U.S. Pat. No. 7,819,763 | Apr. 21, 2005 | Oct. 26, 2010 | Campbell; Steven S<br>Campbell; Mathew B<br>Campbell; Eric C | Baseball batting trainer |
| U.S. Pat. No. 6,030,299 | Aug. 25, 1997 | Feb. 29, 2000 | Denny; Michael S | Baseball training device |
| U.S. Pat. No. 5,597,160 | Jun. 28, 1995 | Jan. 28, 1997 | Mims; Calvin | Baseball batting training apparatus |
| U.S. Pat. No. 5,531,438A | Oct. 26, 1994 | Jul. 2, 1996 | Corley; Deryl | Baseball practice device |
| US20110003653A1 | Jul. 1, 2010 | Jan. 6, 2011 | Stemle; Stephen J | Throwing target, system and method |
| US20130012340A1 | Jul. 10, 2011 | Jan. 10, 2013 | Kanner; David<br>Fick; Anthony C | Baseball swing training device |
| US20120052988A1 | Apr. 27, 2010 | Mar. 1, 2012 | Pijanowski; Jerry | Portable target game training device |
| U.S. Pat. No. 5,228,683 | Apr. 20, 1992 | Jul. 20, 1993 | Beimel; Roger G. | Baseball batters training device |
| U.S. Pat. No. 5,303,914 | Jul. 12, 1993 | Apr. 19, 1994 | James N. Cooksey | Triple-adjustable batting device |
| U.S. Pat. No. 5,582,403 | Jan. 26, 1995 | Dec. 10, 1996 | George; Robert | Baseball training device |
| U.S. Pat. No. 5,711,726 | Jul. 15, 1994 | Jan. 27, 1998 | Powers; Steven B. | Batting simulator apparatus |
| U.S. Pat. No. 5,957,788 | Apr. 1, 1997 | Sep. 28, 1999 | Eze; Obi Walter | Sports practice apparatus |
| U.S. Pat. No. 6,390,939 | Sep. 29, 2000 | May 21, 2002 | Jose A. Palacios | Batting practice device |
| U.S. Pat. No. 8,246,492 | Mar. 4, 2010 | Aug. 21, 2012 | Gangelhoff Joel T | Baseball/softball batting tee |

SOME CLASSIFICATIONS RESEARCHED

| | |
|---|---|
| U.S. Classification | 473/417, 473/422, 473/425, 473/429, 473/451, 473/453 |

I claim:

1. An Apparatus for training three specific player-positions in the sport of baseball, either individually, in pairs or all three at the same time, while providing the accuracy and restriction needed for leveraging the effectiveness of each specific player-position, comprising:

a support base having a clamping collar attached to an upper surface of the support base, said support base for placement on a substantially horizontal surface, wherein said clamping collar further includes a threaded coupling secured thereto;

a post, removeably received within said threaded coupling, said post including a tee-collar;

a pipe slidably received within said post, said pipe allowing for free adjustment to an individualized strike zone height position, wherein said pipe includes an elbow collar attached at an upper end of said pipe;

a first horizontal rod mounted to said elbow collar of said pipe, and a first pair of tee-extensions slidably received on said first horizontal rod and extending downwardly for defining an inner and outer boundary of a strike zone; and a second horizontal rod mounted to said tee-collar on said post, and a second pair of tee-extensions slidably received on said second horizontal rod and extending upwardly for defining an inner and outer boundary of a strike zone;

wherein said apparatus is positioned in a batter's box opposite a batter, with an adjusted personalized strike zone extending to and just in front of a home plate, allowing a "True Strike Zone" to be visualized simultaneously by all three inter-dependent player positions i.e. pitcher, catcher and batter and allowing each to master their player position skills, while allowing an entire baseball team to practice fielding hit baseball(s).

2. The apparatus of claim 1, wherein said base includes first and second support legs and a flat surface positioned therebetween.

3. The apparatus of claim 1, wherein said first and second horizontal rods are formed of a flexible fibrous glass material and said first and second pair of tees are formed of a Polyvinylchloride material.

4. The apparatus of claim 3, wherein said first and second horizontal rods, said first and second pair of tee-extensions, said post and said pipe are enclosed in a diamond-shaped double edged deflective style closed cell rubber molded covering.

5. The apparatus of claim 4, wherein the coverings absorbs and helps reduce impact of and deflect a baseball bat or baseball when struck.

6. The apparatus of claim 4, wherein said coverings define the boundaries of a strike zone, the covering further defined by first, second and third colors, wherein the first color indicates when a baseball is just outside the strike zone, the second color different from the first color defines when a baseball is way outside the strike zone, and the third color different from the first and second colors defines when a baseball is within the strike zone.

7. The apparatus of claim 1, wherein said post is formed of a first outer tubing having a threaded collar at an upper end, and a second inner tubing having a tee coupling at a lower end, said second inner tubing secured to said first outer tubing.

8. The apparatus of claim 7, wherein said first outer tubing, said second inner tubing and said pipe are formed from metal.

9. The apparatus of claim 7, wherein the pipe is black in color.

* * * * *